US006053182A

United States Patent [19]

Harmell

[11] Patent Number: 6,053,182

[45] Date of Patent: Apr. 25, 2000

[54] METHOD AND APPARATUS FOR ATTACHING JEWELRY TO HAIR

[76] Inventor: Heather Joy Harmell, 1826 20th St., Suite 102, Santa Monica, Calif. 90404

[21] Appl. No.: 09/295,704

[22] Filed: Apr. 21, 1999

[51] Int. Cl.[7] ..... A45D 8/12

[52] U.S. Cl. ..... 132/275; 132/273

[58] Field of Search ..... 132/273, 275, 132/276, 278; 24/104, 108, 464, 97; 63/29.1, 29.2, 28, 43, 14.1

[56] References Cited

U.S. PATENT DOCUMENTS

| | | | |
|---|---|---|---|
| 1,536,189 | 5/1925 | Codman | 63/29.1 |
| 2,818,871 | 1/1958 | Beaudry | 132/278 |
| 3,412,739 | 11/1968 | Thatcher | 132/278 |
| 3,530,550 | 9/1970 | White | 24/464 |
| 3,595,201 | 7/1971 | Oudenhoven | 24/108 |
| 4,344,240 | 8/1982 | Schiller | 24/108 |
| 5,113,553 | 5/1992 | Hutchinson | 24/464 |
| 5,115,649 | 5/1992 | Amber | 63/29.1 |

*Primary Examiner*—Gene Mancene
*Assistant Examiner*—Pedro Philogene
*Attorney, Agent, or Firm*—Eric Ho

[57] ABSTRACT

A hair jewelry fastener that securely attaches jewelry to one's hair. The hair jewelry fastener includes a male half having a base with a first surface and a second surface for receiving a decorative portion. A protrusion extends from the first surface of the base and has a hair gripping surface and an enlarged portion that defines a lip and a hair contacting surface. A female half that hingedly couples to the male half is provided so that the male part and the female part can be placed into a mating engagement. The female half has a first surface that defines an opening that receives the protrusion and a second surface for defining hair receiving grooves. When the protrusions snapped into the opening, hair gripping surface and first surface of the female half securely attach the jewelry to one's hair.

14 Claims, 10 Drawing Sheets

METHOD AND APPARATUS FOR ATTACHING JEWELRY TO HAIR

BACKGROUND OF THE INVENTION

1. Field of the Invention

The present invention relates generally to jewelry, and more specifically, relates to a method and apparatus for attaching jewelry to one's hair.

2. Description of the Related Art

Jewelry has been and continues to be an important and desired accessory to adorn and highlight one's appearance. Jewelry for one's head, such as ear-rings, are also very popular and commonly used. In the past, the only adornment for one's hair has been the unattractive, large decorations that were affixed to hair bands, hair clips, and other accessories for holding hair or otherwise securing hair in a way that is intended to impair the movement of the hair. An example of this type of accessory are hair clips that are worn to keep the hair back away from the face.

Recently, there has been much interest in jewelry for one's hair. An important consideration in the design of hair jewelry is that the approach used to attach the jewelry to one's hair provide a "floating effect." The "floating effect" makes the jewelry appear to a viewer to float and be magically attached without any visible structure to one's hair. An important component to support the "floating effect" is the use of many jewelry that are attached to different strands of hair so that as different strands of hair move independent of other strands, the jewelry moves in a correspondingly independent fashion with respect to other pieces of jewelry. Accordingly, conventional hair clips that have a decorative part cannot produce this effect since the clip portion is prominent and is designed specifically to limit and impair the movement of the hair.

Additionally, in the design of hair jewelry it is important to meet the following criteria: (1) a hair jewelry where the decorative or ornamental aspects are the primary and most noticeable features; and (2) hair jewelry that naturally moves in a flowing motion with one's hair. Unfortunately, the hair clips described previously are clumsy and fail to meet both of these criteria. In fact, the decorations on hair clips and hair holding accessories are secondary effects and often more of an after thought rather than a primary consideration since for the hair clips to perform their function, the functional structures are necessarily very prominent and observable. In addition, these hair clips by their very functional nature restrict and impair the movement of hair thereby precluding the possibility of natural movement with one's hair.

Accordingly, new approaches to attach jewelry that try to address the two criteria set forth above have been attempted. One approach utilizes Velcro™ material and static friction and to attach jewelry to one's hair Unfortunately, this approach is unreliable, and a common complaint is that the jewelry easily shifts and becomes detached from the hair, thereby increasing the frustration of a user and also the likelihood of losing the jewelry.

Another approach utilizes a two piece metal clothing snap to attach jewelry to one's hair. Since metal clips are designed to keep two pieces of cloth together, such as jeans or a shirt, these clips perform a very poor job of securing jewelry to hair. Unfortunately, as like the first approach, this second approach is unreliable in that the jewelry easily shifts and becomes detached from the hair. Furthermore, the metal snap is easily rendered useless when a backing portion is lost or misplaced.

Accordingly, there remains a need for a method and apparatus for attaching jewelry to one's hair that provides a "floating effect" while overcoming the advantages set forth previously.

SUMMARY OF THE INVENTION

It is one object of the present invention to provide a hair jewelry fastener that securely attaches the hair jewelry to one's hair.

It is another object of the present invention to provide a hair jewelry fastener with hair receiving grooves that provide ease of attachment to one's hair by acting as a guide for receiving the hair and also provides additional fastening support when fastener is in a closed or fastened position.

It is another object of the present invention to provide a hair jewelry fastener where the fastener portion is not noticeable in order to highlight the decorative or ornamental aspects so that the primary and most noticeable features of the hair jewelry are the decorative portions.

It is a further object of the present invention to provide a hair jewelry fastener that naturally moves in a flowing motion with one's hair without impairing the movement of one's hair.

It is yet another object of the present invention to provide a hair jewelry fastener that provides a "floating effect" which makes the jewelry appear to a viewer to float and be magically attached to one's hair without any visible structure.

It is yet another object of the present invention to provide a hair jewelry fastener that allows for multiple pieces of jewelry to be attached to different strands of hair so that as different strands of hair move independent of other strands, the jewelry moves in a correspondingly independent fashion with respect to other pieces of jewelry.

It is a further object of the present invention to provide a hair jewelry fastener hat can be manufactured as a single piece of clear plastic so that components of the fastener do not become detached or lost.

It is a further object of the present invention to provide a hair jewelry fastener that is easy to attach to and remove from one's hair.

It is a further object of the present invention to provide a hair jewelry fastener that can be manufactured in a cost effective manner and be easily assembled with a decorative part with minimal labor.

It is a further object of the present invention to provide a hair jewelry fastener whose profile and setting can be tailored to accommodate different decorative parts.

In order to accomplish the objects of the present invention, a hair jewelry fastener that securely attaches jewelry to one's hair is provided. The hair jewelry fastener includes a male half having a base with a first surface and a second surface for receiving a decorative portion. A protrusion extends from the first surface of the base and has a hair gripping surface and an enlarged portion that defines a lip and a hair contacting surface. A female half that hingedly couples to the male half is provided so that the male part and the female part can be placed into a mating engagement or fastened position. The female half has a first surface that defines an opening that receives the protrusion and a second surface for defining hair receiving grooves. When the protrusion is snapped into the opening, an outer surface of the protrusion and first surface of the female half securely attach the jewelry to one's hair.

BRIEF DESCRIPTION OF THE DRAWINGS

The objects, features and advantages of the method and apparatus for the present invention will be apparent from the following description in which.

DETAILED DESCRIPTION OF THE INVENTION

Referring to the figures, exemplary embodiments of the invention will now be described. The exemplary embodiments are provided to illustrate aspects of the invention and should not be construed as limiting the scope of the invention. The exemplary embodiments are primarily described with reference to the figures.

Figure 1:
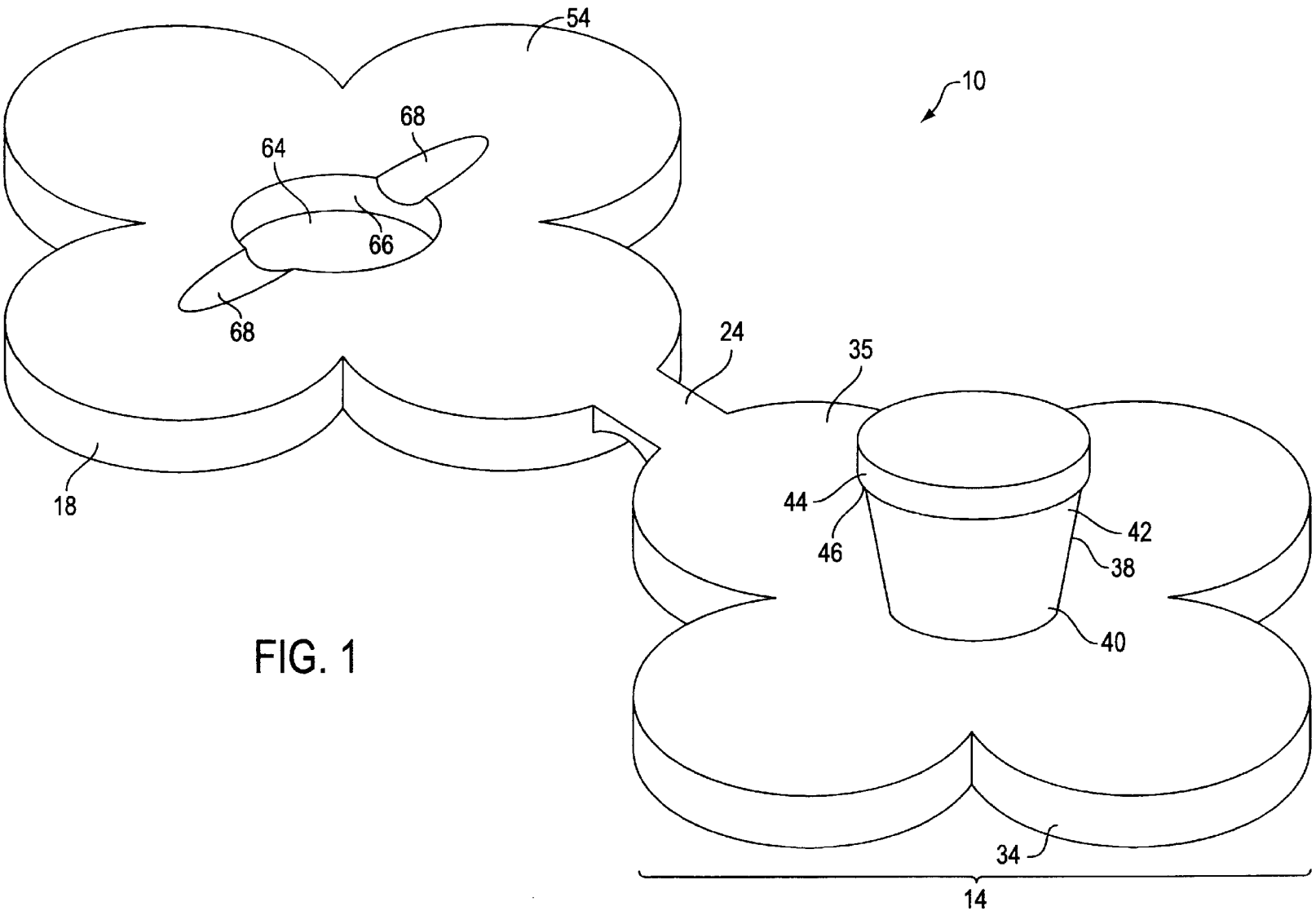
FIG. 1 illustrates an inside perspective view of the jewelry attachment structure of the present invention in an open position.

FIG. 1 illustrates an inside perspective view of the jewelry attachment structure 10 of the present invention in an open or un-locked position. Jewelry attachment structure 10 (also referred to herein as hair jewelry fastener) includes a male portion 14 (male half) and a female portion 18 (female half) hingedly coupled thereto. In one embodiment, a connection piece 24 is provided to connect male half 14 and female half 18 to prevent the loss of either half of fastener 10. Preferably, the male portion 14, female portion 18, and connection piece 24 are formed as a single piece of clear plastic by a manufacturing process, such as by a plastic injection mold process. In this embodiment, connection piece 24 should be made from a material that has sufficient flexibility so that male portion 14 can be folded over hinge portion 24 to mate or engage with female portion 18 as will be described in greater detail hereinafter with reference to FIG. 3.

Alternatively, when fastener 10 is made from a metal, such as gold, silver, or platinum, connection piece 24 can be a hinge made from the same metal. It is noted that male portion 14 and female portion 18 can be two separate pieces, and the male portion 14 and female portion 18 can be hingedly coupled by the connection piece 24. Connection piece 24 can be a string, thread, wire, plastic, nylon, fabric, etc.

Male portion 14 includes a relatively planar base portion 34 having a first surface 35 (also referred to hereinafter as an inner surface) and a second surface 36 (also referred to hereinafter as an outer surface). Male half 14 also includes a protrusion 38 extending from first surface 35 in a generally perpendicular fashion. Protrusion 38 has a first end 40 coupled to base portion 34 and a second end 42 having a enlarged portion 44 with a lip 46. In one embodiment, protrusion 38 has a diameter of approximately 2 mm and a height of about 2 mm. The width of protrusion 38 can be substantially the same from the second end 42 to the first end 40 or can decrease in a tapered fashion from the second end 42 to the first end 40 (as shown).

In one embodiment, the circumference of enlarged portion 44 can be greater than the circumference of opening 64 so that once in the closed position, structure 10 remains closed until sufficient force is exerted by a user to pull male portion 14 and female portion apart 18. Similarly, a user must exert a sufficient force to overcome the frictional resistance provided by enlarged portion 44 against opening 64 which has a smaller circumference than the circumference of enlarged portion 44 and to snap male portion 14 and female portion 18 together into a mating engagement.

Alternatively, the circumference of enlarged portion 44 can be substantially the same or less than the circumference of opening 64. In this case, fastener 10 is maintained in a fastened or closed position by the frictional engagement of the hair, outer surface of protrusion 38 and inner surface 66, as well as, the frictional engagement between the grooves 68 and surface 35.

In one embodiment, male half 14 and female half 18 each has a clover-like shape to accommodate one type of jewelry design. It is noted that the shape or profile of base portion 34 of male portion 14 and female portion apart 18 can be tailored to a particular jewelry or decorative piece.

Female portion 18 includes a first surface 54 and a second surface 58. In one embodiment, female half 18 has a size of approximately 4 mm by 4 mm by 0.5 mm. Inner surface 66 of female portion 18 defines an opening 64 for receiving protrusion 38 when structure 10 is closed to fasten to one's hair. In one embodiment, opening 64 has a diameter of approximately 2 mm. First surface 54 of female portion 18 further defines two opposite hair receiving grooves 68 that receive a length of several strands of hair. These grooves 68 can be extended to stretch completely the length of second surface 54 of female portion 18 or a partial length thereof. Grooves 68 help to fasten structure 10 to one's hair when structure 10 is in the closed position and to guide or channel strands of hair to become threaded through opening 64. For example, in the lock position, grooves 68 receive 20–60 human hairs and securely hold these hairs between inner surface 66, external surface of protrusion 38, and inner surface 35. In one embodiment, grooves 68 has a size of approximately 0.5 mm by 0.5 mm by 0.5 mm.

In order to increase the frictional engagement between inner surfaces 35, 54 and to provide additional hair holding support, a material, such as a rubber material, quick-drying glue or epoxy, can be applied to surface 54, surface 35 or both. In addition, micro-bumps or protrusions and corresponding micro-recesses or grooves can be manufactured into inner surfaces 35, 54 to further increase the hair holding ability of fastener 10.

Figure 2:
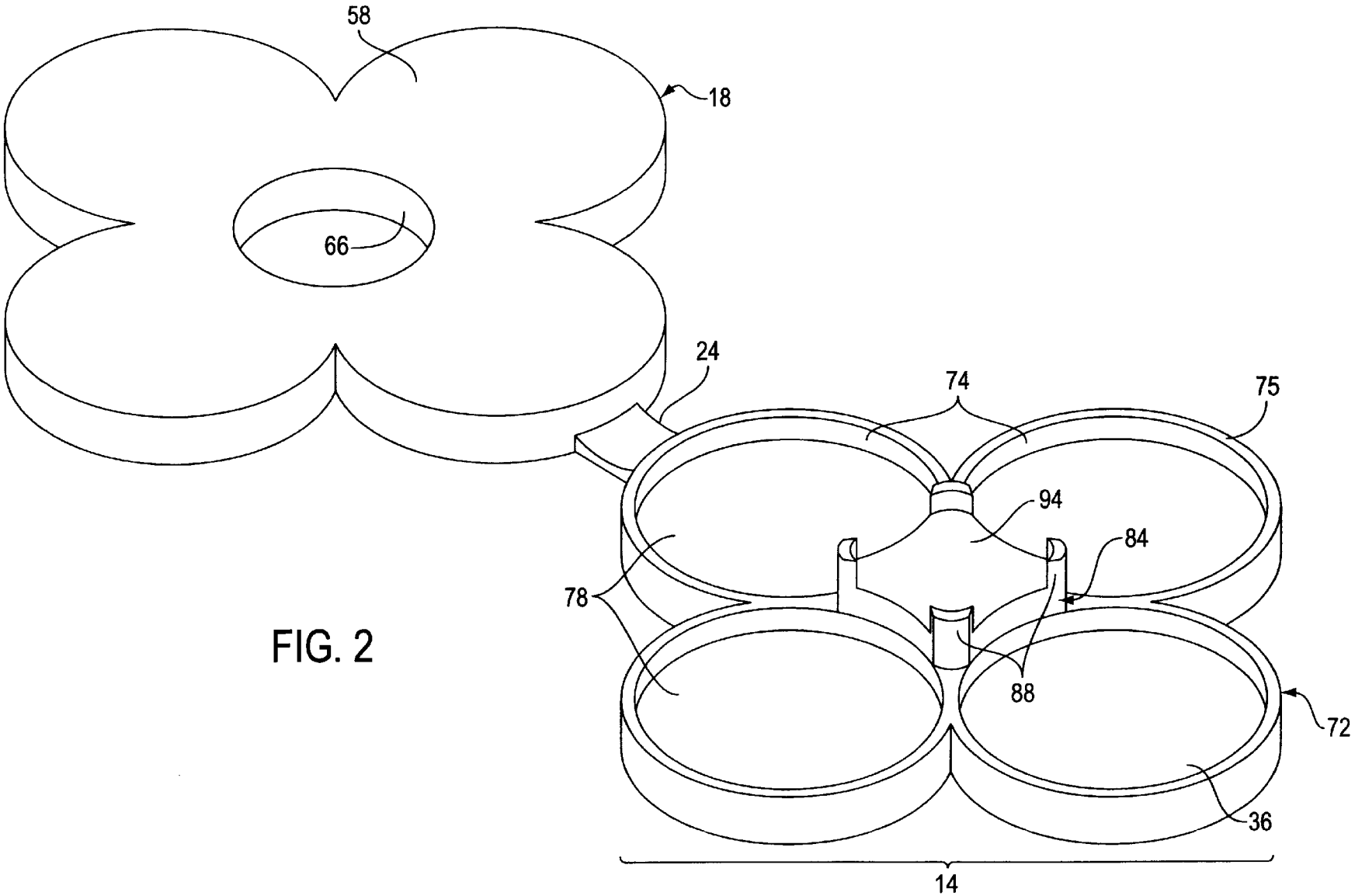
FIG. 2 illustrates an outside perspective view of the jewelry attachment structure of FIG. 2.

FIG. 2 illustrates an outside perspective view of the jewelry attachment structure 10 of FIG. 1. Male half 14 includes a setting 72 for supporting and receiving a decorative part, such as the crystal flower design 100, illustrated in FIG. 5. The shape and size of setting 72 can be configured to accommodate a specific jewelry design as will be explained in greater detail hereinafter.

Setting 72 includes at least one frame 74 that defines a bed for receiving the decorative part. In this embodiment, there are four frames 74 that each define a corresponding bed 78. Each bed 78 receives one of the four crystals (described in greater detail hereinafter with reference to FIG. 5). Each frame 74 has a top surface 75. An elevated platform 84 is disposed on a portion of the top surfaces 75 of the frames 74. Platform 84 includes a plurality of posts 88 that define an elevated bed 94 for receiving a fifth crystal. It is noted that adhesive can be applied to the beds 78, 94 to affix a decorative part to fastener 10.

Figure 3:
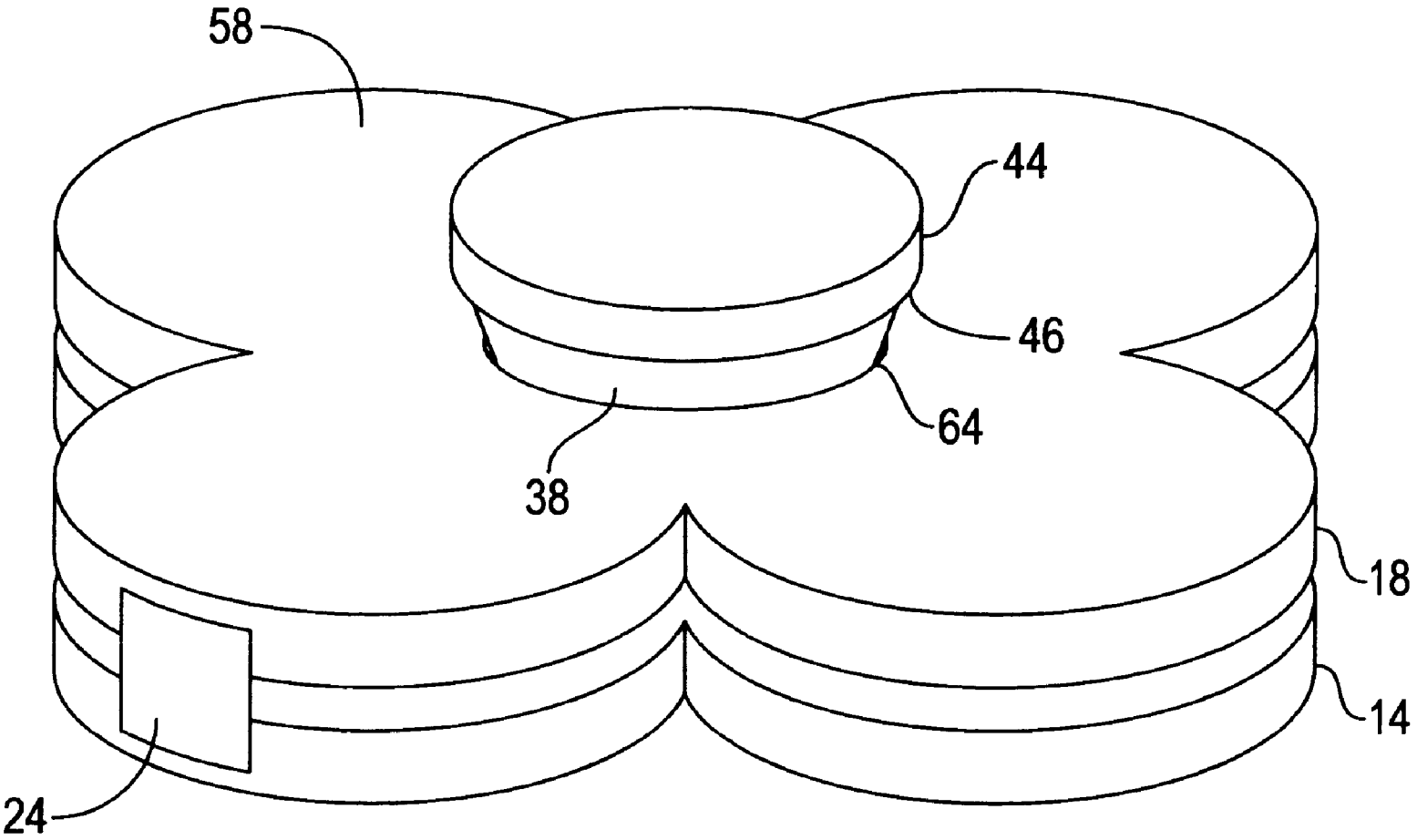
FIG. 3 illustrates a bottom perspective view of the jewelry attachment structure of the present invention in a closed position.

FIG. 3 illustrates a bottom perspective view of the jewelry attachment structure 10 of the present invention in a closed or locked position. In the locked position, fastener 10 securely attaches to one's hair as will be described in greater detail hereinafter with reference to FIG. 7. Also, in the locked position, male half 14 and female half 18 are folded about hinge 24 so that protrusion 38 is in mating engagement with opening 64. In particular, lip 46 is provided to abut against surface 58 of female half 18 to prevent fastener 10 to be unintentionally un-locked or opened. In one embodiment, fastener 10 has a size of approximately of 9 mm by 9 mm by 3 mm. As noted previously, the size and the profile or shape of fastener 10 can be tailored to the size and shape of the decorative part.

Figure 4:
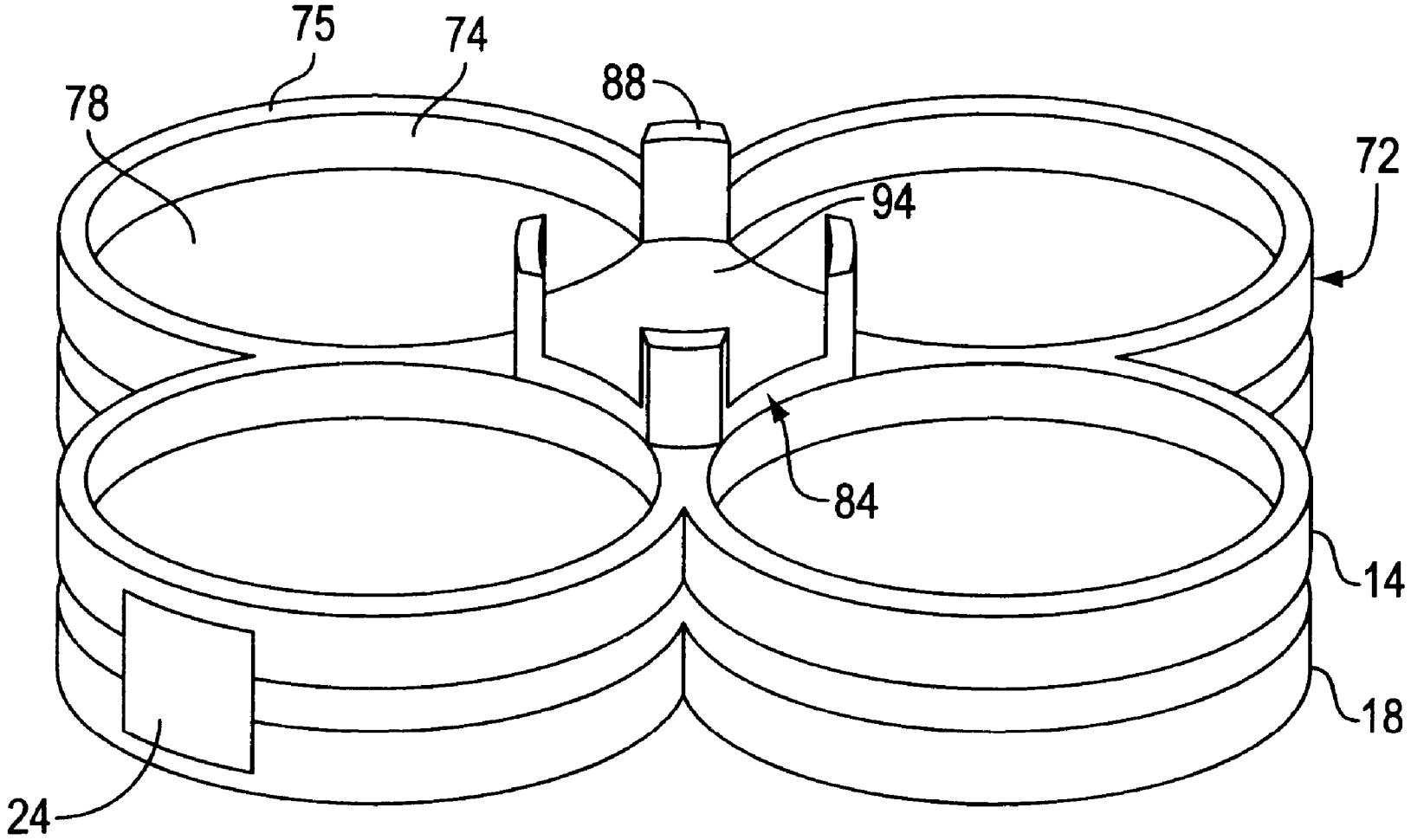
FIG. 4 illustrates a top perspective view of the jewelry attachment structure of FIG. 3 in a closed position.

FIG. 4 illustrates a top perspective view of the jewelry attachment structure 10 of FIG. 3. The setting 72, frames 74, beds 78, elevated platform 84, posts 88, and elevated bed 94, described previously, are again clearly shown in this figure. It is noted that the decorative part has not yet been affixed to fastener 10.

Figure 5:
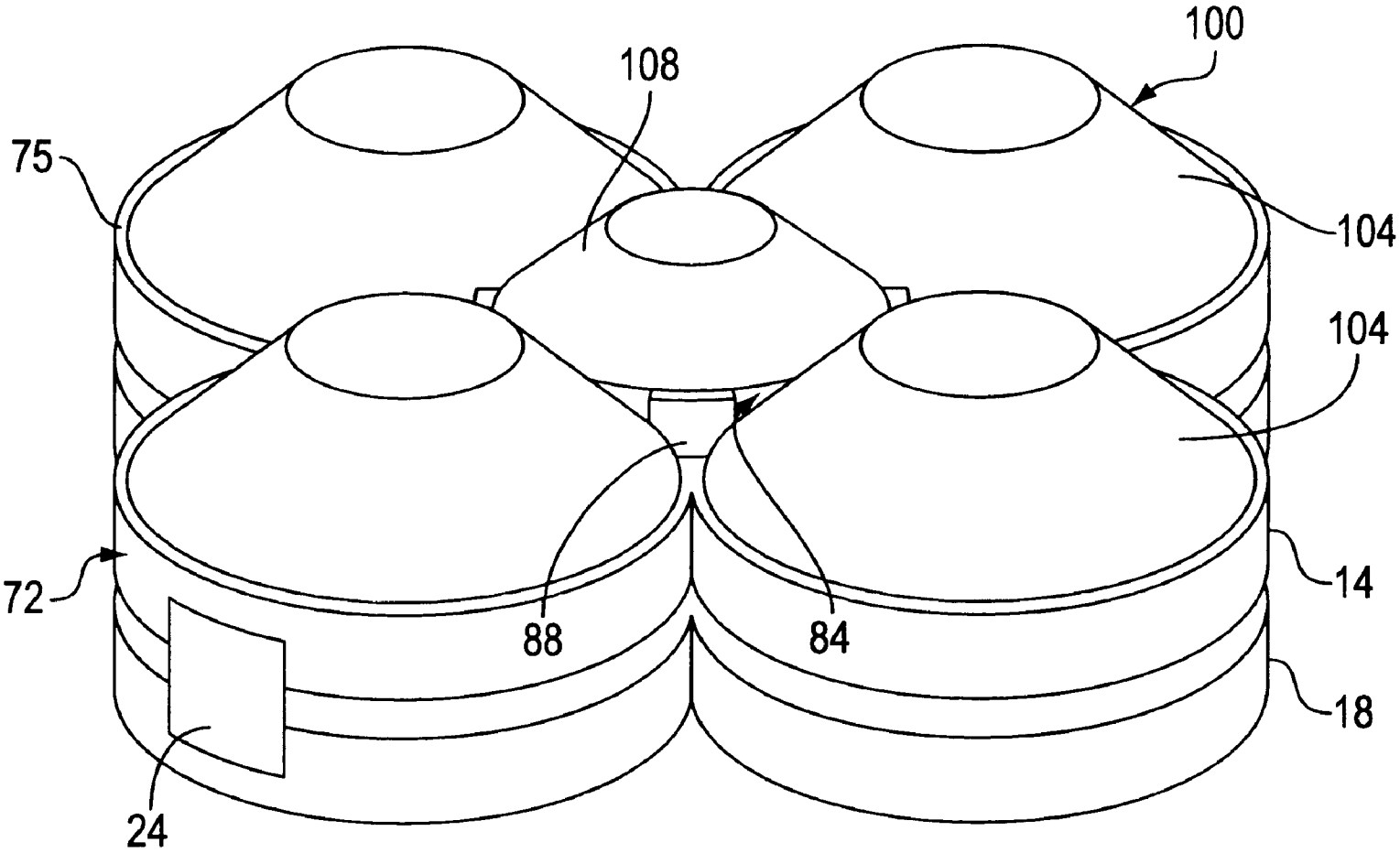
FIG. 5 illustrates a top perspective view of the jewelry attachment structure of FIG. 4 having decorative crystals disposed in the beds.

FIG. 5 illustrates a top perspective view of the jewelry attachment structure 10 of the present invention having a decorative part 100 disposed in setting 72. Decorative part 100 is the visible hair jewelry that is applied to hair jewelry fastener 10 and supported by setting 72. In this embodiment, decorative part 100 is a five-crystal flower design that features four crystal rhinestones 104 that each have a diameter of approximately 4 mm and a fifth crystal 108 that is smaller than the first four crystals 104 and has a diameter of approximately 3 mm. Each crystal 104 is supported by a corresponding bed 78 described earlier. The four crystals 104 are arranged in the shape of a square to resemble four flower petals. Fifth crystal 108 is supported by elevated bed 94. Crystals 104, 108 can be affixed to the corresponding beds 78,94 through the use of glue, epoxy, or other adhesive material.

Figure 9:
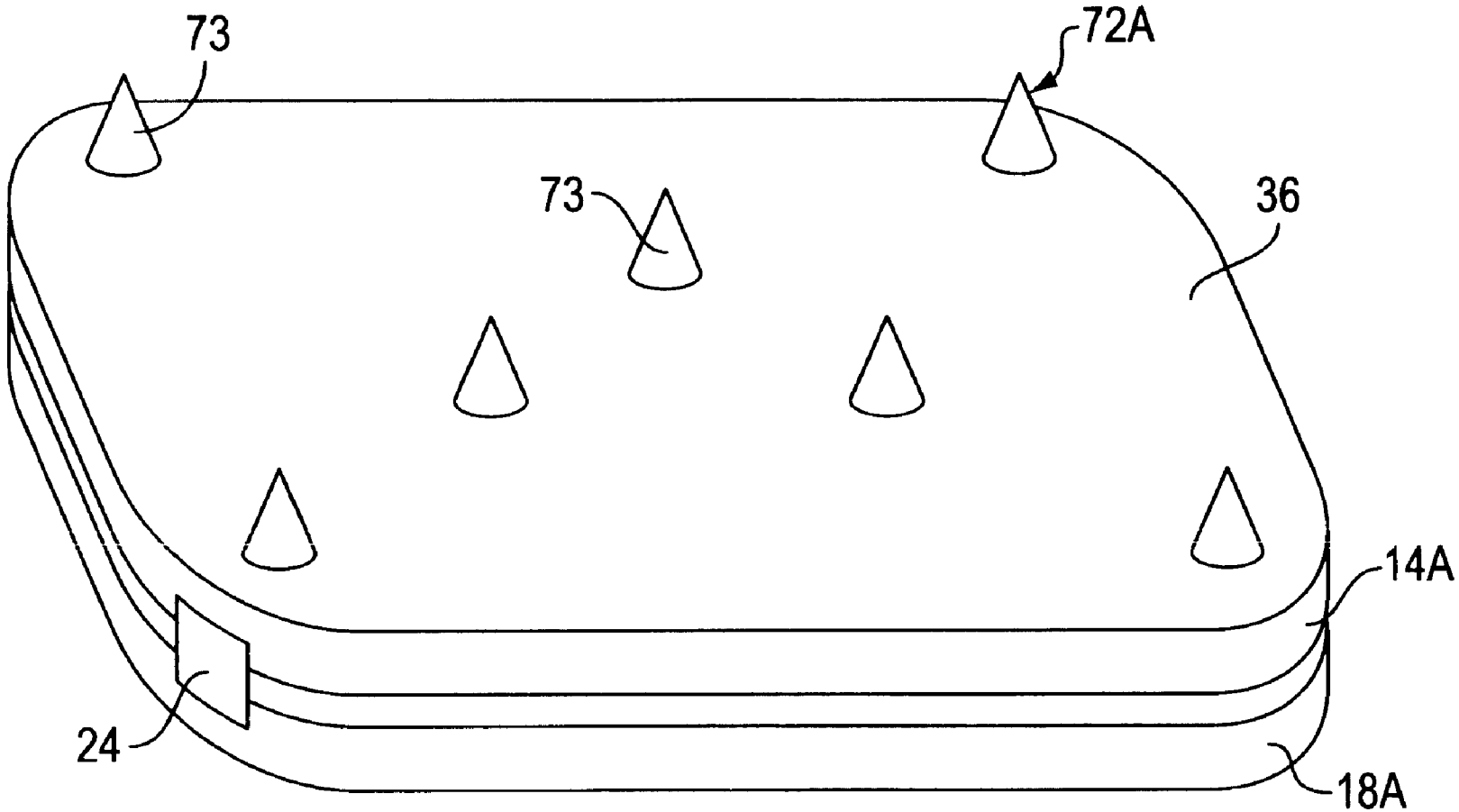
FIG. 9 illustrates a top perspective view of the jewelry attachment structure that is configured in accordance with an alternative embodiment of the present invention.
Figure 10:
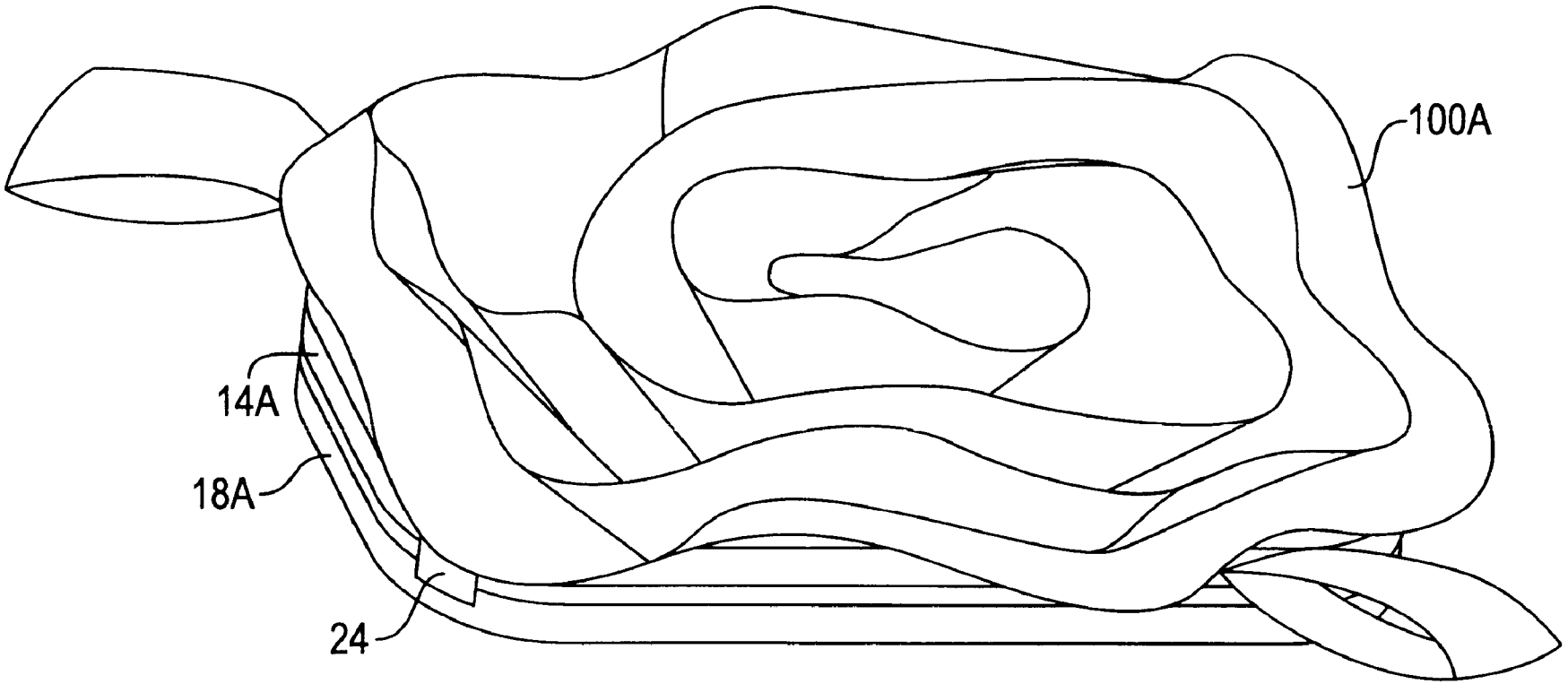
FIG. 10 illustrates a top perspective view of the jewelry attachment structure of FIG. 9 having a decorative flower disposed thereon.

Decorative part 100 can include, but is not limited to jewels, gems, stones, rhinestones, crystals, fabric, flower ornaments (e.g., satin flowers), pearls, diamonds, mirrors, reflective pieces, beads, rubies, small adornments, ornaments, and decorations. For example, FIG. 9 and FIG. 10 illustrate an alternative embodiment of the present invention that is tailored to receive a flower ornament. Specifically, FIG. 9 illustrates a top perspective view of the jewelry attachment structure where the profile of the male half 14A and female half 18A has a generally rectangular shape, and setting 72A includes a plurality of spiked portions 73 for securing the flower ornament to second surface 36 of male half 14A. FIG. 10 illustrates a top perspective view of the jewelry attachment structure of FIG. 9 having a decorative flower 100A disposed in setting 72A. Decorative flower 100A can be affixed to second surface 36 by an adhesive material such as glue or epoxy.

Figure 6:
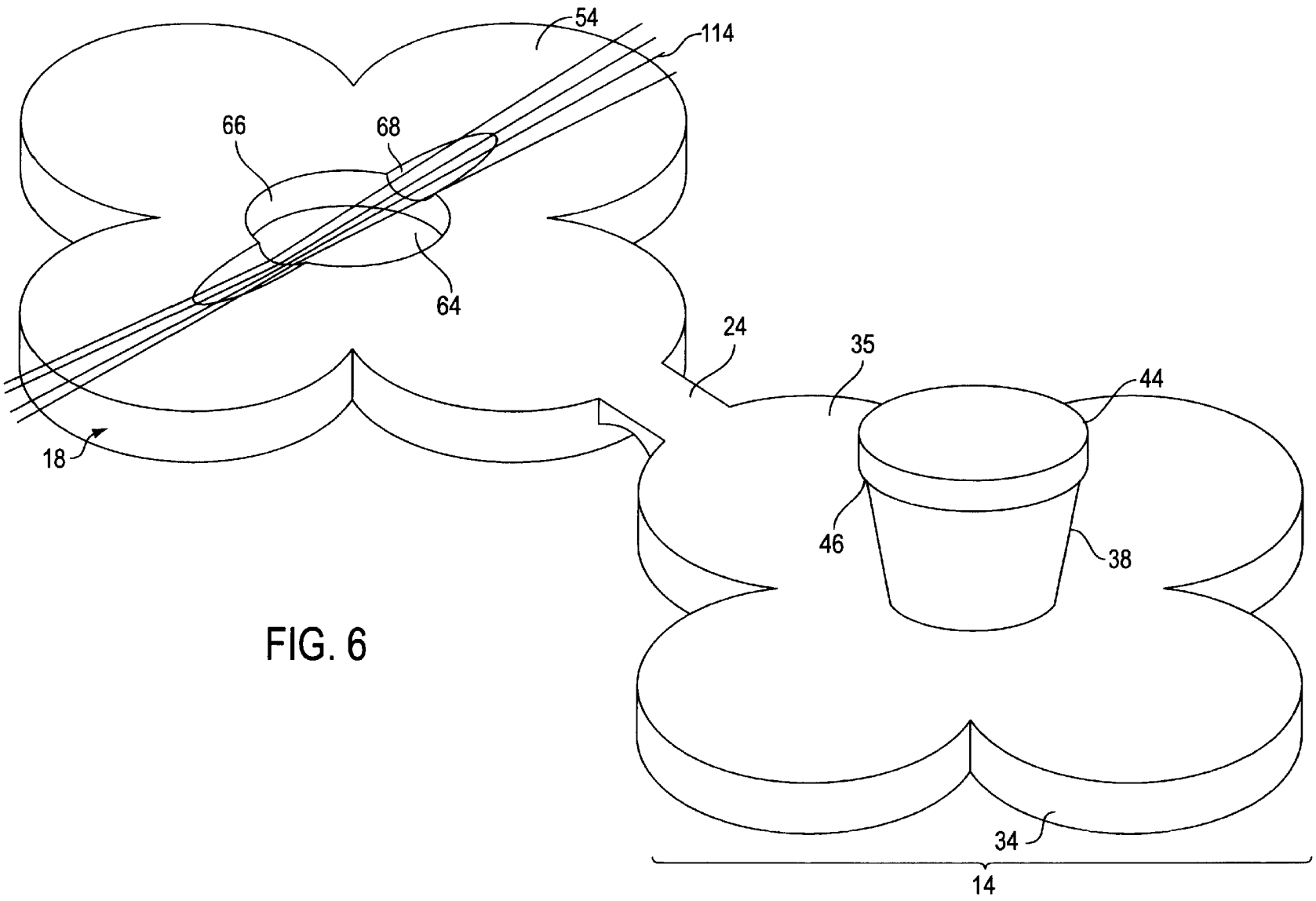
FIG. 6 illustrates how the jewelry attachment structure is positioned with respect to one's hair when the structure in the open position.

FIG. 6 illustrates how the jewelry attachment structure 10 is positioned with respect to one's hair 114 when the structure 10 is in the open position.

Figure 7:
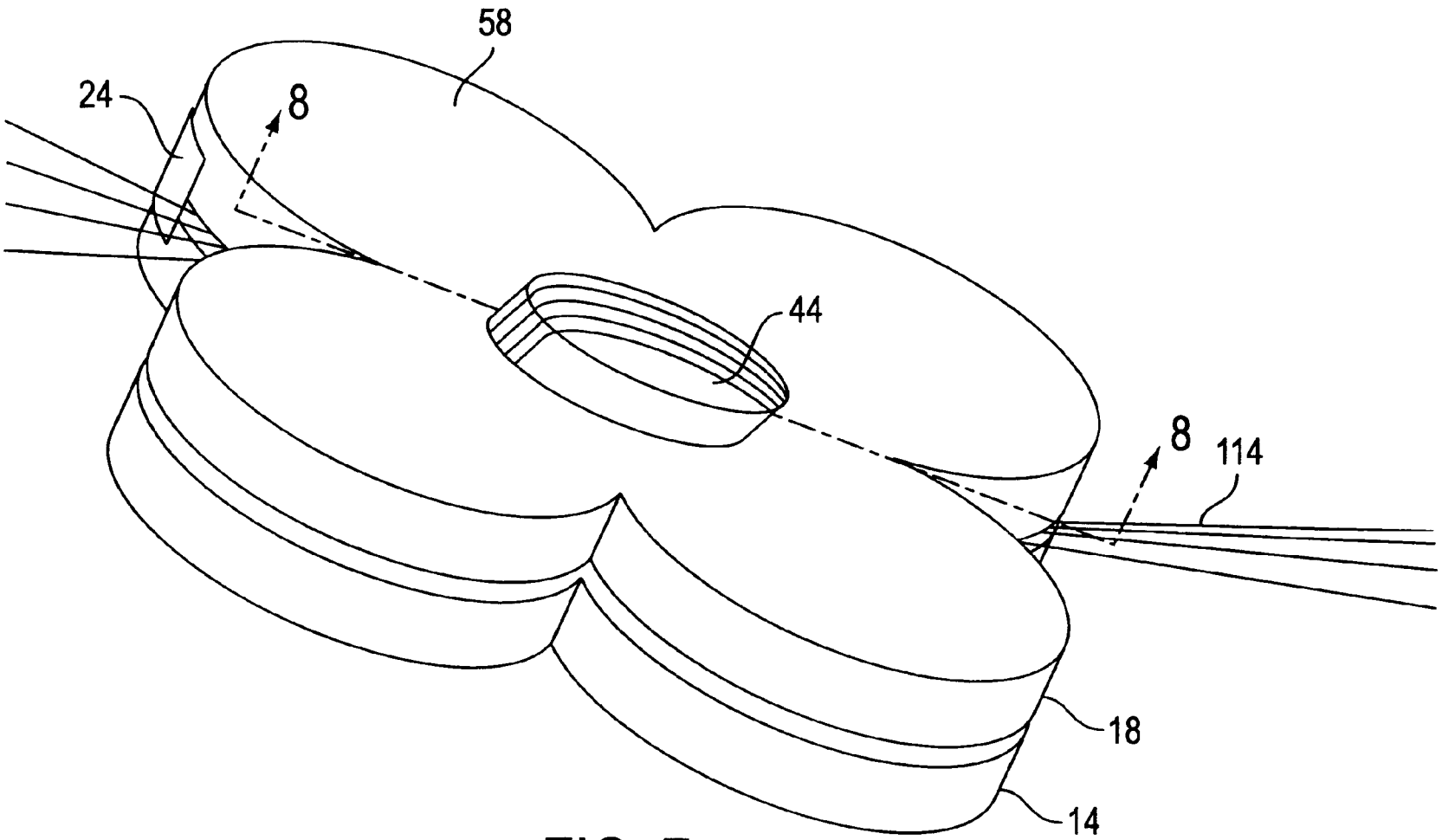
FIG. 7 illustrates how the jewelry attachment structure is securely fastened on one's hair when the structure is closed upon the hair and in the closed position.
Figure 8:
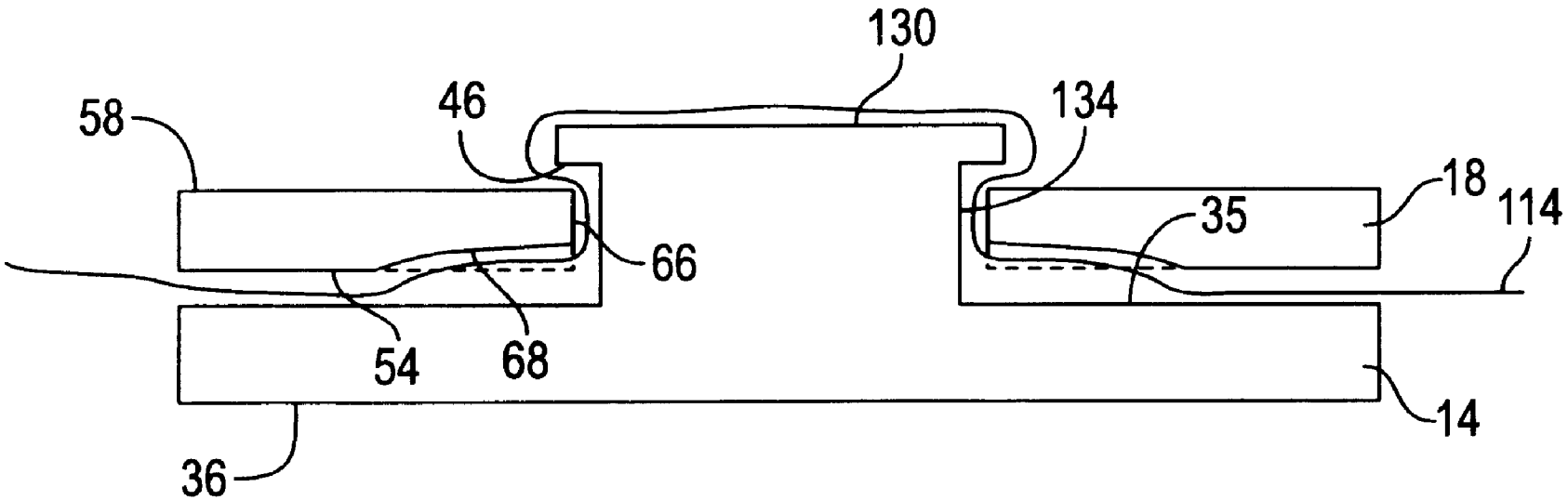
FIG. 8 illustrates a sectional view of FIG. 7 through line 8—8.

FIG. 7 illustrates the jewelry attachment structure 10 securely fastened on one's hair 114 when the male half 14 is snapped into a mating engagement with female half 18. FIG. 8 illustrates a sectional view of FIG. 7 through line 8—8. When fastener 10 is in the locked position, hair 114 can be held by the frictional engagement between surface 35 of male half 14 and surface 54 of female half 18, between groove 68 and surface 35 of male half, and between surface 134 of protrusion 38 and surface 66 of female half 18, and between lip 46 and surface 58 of female half 18. One or more of these surface pairs provide support to securely fasten the hair jewelry to one's hair. Hair 114 also can contact surface 130 enlarged portion 44.

METHOD OF ATTACHING AND REMOVING THE PRESENT INVENTION TO AND FROM ONE'S HAIR

1. Place structure 10 into an open position for receiving hair.
2. Position strands of one's hair on female half 18 and in particular across first surface 54, opening 64, and grooves 68.
3. Snap close the male half 14, threading protrusion 38 through opening 64 to place female half 18 and male half 14 into mating engagement As illustrated in FIG. 8, when in the closed or locked position, hair 114 is held through the frictional engagement between surface 134 of protrusion 38 and inner surface 66, between surfaces of grooves 68 and surface 35 of male portion 14, between surface 35 of male half 14 and surface 54 of female half 18, and between lip 46 and surface 58 of female half 18.
4. Repeat steps (1) through (4) until the desired number of hair jewelry and desired effect have been achieved.
5. In order to remove or unlock fastener 10, one simply applies an outward force to separate or pull apart male half 14 from female half 18.

Accordingly, the fastener 10 of the present invention allows hair jewelry to be easily fastened to one's hair and easily removed from one's hair. Because of the unique gripping features of the present invention, fastener 10 grips and attaches to hair without slipping, sliding, or becoming unintentionally unfastened. In addition, the present invention maintains a secure grip on hair without impairing the natural movement of hair thereby allowing the hair jewelry to move independently with the 5 strands of hair to which it is attached. Furthermore, the present invention has a novel shape and profile that is tailored to the decorative part so as to hide the fastener and accents the ornament or jewelry thereby creating the "floating effect."

Accordingly, the present invention has been described with some degree of particularity directed to the exemplary embodiments of the present invention. The exemplary embodiments described herein are provided merely to illustrate the principles of the invention and should not be construed as limiting the scope of the invention. For example, the size and profile or shape of the male half and female half can be tailored to suit a particular decorative parts shape and size. In addition, the setting of the male half can also be configured differently depending on the shape of the decorative part in order to best hold or support the decorative part It should be appreciated, though, that the present invention is defined by the following claims construed in light of the prior art so that modifications or changes may be made to the exemplary embodiments of the present invention without departing from the inventive concepts contained herein.

I claim:

1. A hair jewelry fastener comprising:

a) a male half having a base, said base having a first surface and a second surface for receiving a decorative portion, and a protrusion that extends from the first surface of the base;

b) a female half hingedly coupled to the male half, said female half having a first surface for defining an opening that receives the protrusion and a second surface; and c) a setting, disposed on the second surface of the male half, for receiving a decorative part, said setting having four frames, each frame having a top surface and defining a bed for receiving a stone, said setting further including an elevated platform disposed on the top surface of the four frames, said elevated platform having four posts extending therefrom and defining an elevated bed for receiving a fifth stone;

wherein said fastener securely attaches to one's hair when the protrusion is placed into mating engagement with said opening of the female half.

2. The hair jewelry fastener of claim 1 wherein the second surface of the female half defines at least one hair receiving groove for guiding the hair into the fastener and providing additional hair gripping support.

3. The hair jewelry fastener of claim 1 wherein the male half and the female half both have a clover-like shape.

4. The hair jewelry fastener of claim 1 wherein each of the four beds and the elevated bed has a generally circular shape and a diameter, and wherein the diameter of each of the four beds is approximately the same, and the diameter of the fifth bed is less than the diameter of each of the four beds.

5. The hair jewelry fastener of claim 1 wherein the male half and the female half are two separate parts, said fastener further comprising a connecting piece for hingedly coupling the male half and the female half.

6. The hair jewelry fastener of claim 5 wherein the connecting piece is selected from one of string, thread, wire, plastic, and fabric.

7. The hair jewelry fastener of claim 5 wherein the connecting piece is a hinge that connects the male half with the female half.

8. The hair jewelry fastener of claim 5 wherein the male half, the female half, and the connecting piece are integrally formed as a single piece by an injection mold manufacturing process.

9. The hair jewelry fastener of claim 8 wherein the fastener is made from a clear and flexible plastic material.

10. The hair jewelry fastener of claim 1 further comprising an adhesive material to affix a first stone, second stone, third stone, fourth stone, fifth stone to the first bed, second bed, third bed, fourth bed, and elevated bed, respectively.

11. The hair jewelry of claim 10 wherein the decorative part includes one of jewels, gems, stones, rhinestones, crystals, fabric, flower ornaments, pearls, diamonds, mirrors, reflective pieces, beads, ornaments, adornments, and rubies.

12. A hair jewelry fastener comprising:

a) a male half having a base, said base having a first surface and a second surface for receiving a decorative portion, and a protrusion that extends from the first surface of the base;

b) a female half hingedly coupled to the male half, said female half having a first surface for defining an opening that receives the protrusion and a second surface; wherein the male half and the female half both have a generally rectangular shape and c) a setting, disposed on the second surface of the male half, for receiving a flower decorative part, said setting having a plurality of spiked portions for securing the flower decorative part to the male half;

wherein said fastener securely attaches to one's hair when the protrusion is placed into mating engagement with said opening of the female half.

13. The hair jewelry fastener of claim 12 further comprising an adhesive material to affix the flower decorative part to the second surface of the male half.

14. A method of attaching hair jewelry securely to one's hair, said hair jewelry having a decorative part; and a fastener for receiving the decorative part and for securely attaching the hair jewelry to one's hair, said fastener including a male half having a first surface and a second surface for receiving the decorative part, a female half, a hinge for coupling the male half to the female half, said female half defining an opening and a first surface, said male half having a base and a protrusion extending from the base, said protrusion defining a hair gripping surface, a hair contact surface, and an enlarged portion, said method comprising the steps of:

a) placing the hair jewelry into an open position wherein the male half and the female half are not coupled together;

b) threading strands of hair between the hair gripping surface of the protrusion and the opening; and c) snapping the protrusion into a mating engagement with the opening; wherein said hair gripping surface and first surface of the female half securely hold one's hair thereby securing the hair jewelry to one's hair.

* * * * *